US006589578B1

(12) United States Patent
Navarro

(10) Patent No.: US 6,589,578 B1
(45) Date of Patent: Jul. 8, 2003

(54) PACKAGE FOR PULVERULENT EGG PREPARATIONS

(75) Inventor: Gabriel Martinez Navarro, Madrid (ES)

(73) Assignee: Ovosec, S.A., Madrid (ES)

( * ) Notice: Subject to any disclaimer, the term of this patent is extended or adjusted under 35 U.S.C. 154(b) by 0 days.

(21) Appl. No.: 10/048,544

(22) PCT Filed: Aug. 4, 2000

(86) PCT No.: PCT/ES00/00311

§ 371 (c)(1),
(2), (4) Date: Apr. 30, 2002

(87) PCT Pub. No.: WO01/10746

PCT Pub. Date: Feb. 15, 2001

(30) Foreign Application Priority Data

Aug. 4, 1999 (ES) ..... 9901783

(51) Int. Cl.[7] ..... B65D 85/00

(52) U.S. Cl. ..... 426/87; 426/112; 426/115; 73/426; 73/427; 222/158; 206/459.1; 215/365

(58) Field of Search ..... 426/87, 383, 112, 426/115, 298, 299, 614; 222/157, 158

(56) References Cited

U.S. PATENT DOCUMENTS

| | | | | | |
|---|---|---|---|---|---|
| 2,791,367 | A | * | 5/1957 | Mefford | 426/111 |
| 2,800,269 | A | * | 7/1957 | Smith | 426/112 |
| 2,828,858 | A | * | 4/1958 | Tooke | 426/112 |
| 2,918,377 | A | * | 12/1959 | Hurley et al. | 426/112 |
| 3,144,931 | A | * | 8/1964 | Long | 426/112 |
| 3,163,544 | A | * | 12/1964 | Valyi | 426/112 |
| 3,186,850 | A | * | 6/1965 | Anthony | 426/87 |
| 3,434,589 | A | * | 3/1969 | Valtri et al. | 426/111 |
| 3,542,190 | A | * | 11/1970 | Keller | 426/111 |
| 3,924,472 | A | * | 12/1975 | Harris | |
| 4,230,238 | A | * | 10/1980 | Wilson | |
| 4,640,425 | A | * | 2/1987 | Cabernoch | 426/117 |
| 4,803,088 | A | * | 2/1989 | Yamamoto et al. | 426/87 |
| 4,873,100 | A | * | 10/1989 | Dirksing et al. | 426/111 |
| 4,889,249 | A | | 12/1989 | Hulon | |
| 5,384,138 | A | * | 1/1995 | Robbins | 426/111 |
| 5,609,899 | A | * | 3/1997 | Spector | 426/112 |
| 5,662,249 | A | * | 9/1997 | Grosse | |
| 6,180,149 | B1 | * | 1/2001 | Gramm | 426/87 |

FOREIGN PATENT DOCUMENTS

| | | | | |
|---|---|---|---|---|
| CA | 593764 | * | 3/1960 | 426/117 |
| CA | 616160 | * | 3/1961 | 426/117 |
| CA | 704569 | * | 3/1965 | 426/112 |
| DE | 3535653 | * | 4/1987 | 426/87 |
| FR | 2518500 | | 6/1983 | |
| GB | 964542 | | 7/1964 | |
| GB | 2080756 | * | 2/1982 | 426/112 |
| GB | 2227004 | | 7/1990 | |
| JP | 63-275347 | * | 11/1988 | 426/87 |
| JP | 9-24088 | * | 1/1997 | 426/87 |
| JP | 10-137322 | * | 5/1998 | 426/87 |

OTHER PUBLICATIONS

Handbook of Packaging, Paine et al. Blackie Academic & Professional (Pub.) p. 303, 1992.*

Verkauf Kunststoffee, Marketing–Koordination, p. 75, 1982.*

* cited by examiner

*Primary Examiner*—Steve Weinstein
(74) *Attorney, Agent, or Firm*—Sughrue Mion, PLLC

(57) ABSTRACT

An improved package for pulverulent egg preparations, said package being intended for the preparation of egg-based food products without having to manipulate fresh eggs.

2 Claims, 2 Drawing Sheets

PACKAGE FOR PULVERULENT EGG PREPARATIONS

This application is a 371 of PCT/ES00/00311, filed Aug. 4, 2000. The disclosure of which is incorporated herein by reference.

DESCRIPTION

1. Object of the Invention

An improved package for pulverulent egg preparations intended to prepare food containing egg without having to manipulate fresh eggs and losing their characteristics, starting from pulverulent egg to which a certain amount of water is added, so that a product suitable for its use in food is obtained.

2. Description of the State of the Art

Several different forms of packages for pulverulent egg preparations exist, as well as different methods to produce it according to different processes and it always being necessary to add water prior to consumption of the product.

Until now, pulverulent egg has been marketed in large packages and their contents are poured into another container of greater dimensions to which water is then added. This system is rather uncomfortable, since a certain amount of pulverulent egg is lost as it remains stuck to the inside surface of the package or during pouring a certain amount of egg falls outside and cannot be used. Moreover, there is another important problem to obtain the best flavour and harnessing of the product, like adding water, since adding the exact and correct amount of this liquid is quite difficult. Another drawback is to make the mixture, a rather difficult action due to the amount of product and the size of the package, making a perfect homogenisation of the product very complicated.

The same problems arise when packing the pulverulent egg in separate containers, mainly due to the users's ignorance of the exact amount of water that should be added to the pulverulent egg.

A container for concentrated egg products has already been disclosed in the British patent GB 2227004, where a bag is described for the individual preparation of a pasty, non-pulverulent concentrated egg. In spite of reducing the aforementioned problems, this patent still leaves several problems without solution, like the fact that its preparation in a plastic bag is exclusively thought to prepare the mixture and consume the product directly, without possibility of storage. Moreover, the created liquid cannot be easily stored due to the instability of the bag, the impossibility of covering the bag making contamination possible once the latter has been opened and the product mixed and moreover, the preparation of the mixture is difficult since the type of package prevents stirring of the product, making homogenisation difficult, causing a difficult solution of the pasty egg. Another added problem of this package is the existence of several level marks on its outside which makes the consumer doubt when adding the water to make the mixture, besides making different types of mixture possible when there only exists one proportion of the mixture which is perfect, permitting an optimum harnessing of the egg properties.

To solve the aforementioned problems, the present invention has been developed, an improved package for pulverulent egg preparations.

DESCRIPTION

The present invention, an improved package for pulverulent egg preparations perfectly solves the aforementioned drawbacks due to its design.

Basically, the package permits a hygienic manipulation of the pulverulent egg without the need to remove it from its original container, hence preventing contamination thereof, which may be produced with previous pulverulent or pasty egg package systems, since in them it was necessary to remove the egg from its container or the container was not very robust, permitting spillage thereof.

This package is made of a resistant material, whether plastic or glass, allowing easy maintenance in the refrigerator once the mixture has been made, until its expiry date. In other words, it allows storage of the product and it is not necessary to use it immediately as was the previous case. In this way, the mixture characteristics are maintained, as fresh egg, but without need to manipulate it.

The product is especially intended for the food industry whether confectioners, restaurants or at home, permitting a fast and perfect preparation of liquid egg, which latter may be used in different foods but always with the security that the product is not contaminated.

Besides the pulverulent egg, there may be different ingredients or flavours inside the package, their applications being the same as unshelled eggs, like omelettes, sponges, mayonnaise, battering and others. The pulverulent egg, due to its characteristics, and mainly to its low water content, allows its preservation for a long period of time from the manufacturing date, so that it may be recovered at any time.

The package contents, the pulverulent egg, is produced by the automatic shelling of eggs, which prior to their homogenisation and pasteurisation are desiccated by atomisation. After this, the product is subjected to strict physico-chemical and bacteriological tests.

The preparation method of the final product as from the improved package containing the pulverulent egg is simply and fast, obtaining a liquid egg suitable for its consumption. To prepare the final product, it is only necessary to open the hermetically closed package and add water until the horizontal mark appearing on it, so that no doubt may exist regarding the exact amount of water to obtain optimum product conditions. Once the water has been added, it is necessary to mix both ingredients, the water and the pulverulent egg and for this, it is only necessary to close the package again and shake it, without having to move it with a utensil, it being sufficient to shake the container.

Following this method the liquid product obtained is the same as liquid egg obtained from shelling eggs and homogenising the yolk and white thereof by beating, the amount of water to add being the same as that for eggs in the preparation phase of pulverulent egg in the desiccation stage.

By this method of preparation and using this package, an improved preservation of the prepared product is obtained compared with previous systems. The preservation of unprepared egg, that is, in the closed package is greater than that of an egg with the shell when this is not refrigerated, supporting high temperatures without the product suffering.

Due to the package characteristics, the product preparation is very simple without needing to weight nor measure quantities of water, simply having to add water until the measure indicated on the package. For later consumption of the mixture, some egg shaped marks exist on the side of the package, each mark being equivalent to one beaten egg. In this way, the preparation of a mixture is simple with a determined number of eggs different from the capacity of the improved package.

Due both to the pulverulent product and its later packaging and preservation in the container object of the present invention, total bacteriological stability is obtained assuring that during the useful life there is no proliferation of undesirable and pathogenic germs frequently found in egg shell and which during manual shelling of eggs may pass to the non-pasteurised liquid egg.

DESCRIPTION OF THE DRAWINGS

To complete the description of the present invention, an improved package for pulverulent egg preparations, and with the purpose to provide an understanding of the features of the invention in accordance with a preferred practical embodiment thereof, this description is completed with a set of drawings which with an illustrative and non-limiting character are detailed below.

DESCRIPTION OF A PREFERRED EMBODIMENT

Figure 1:
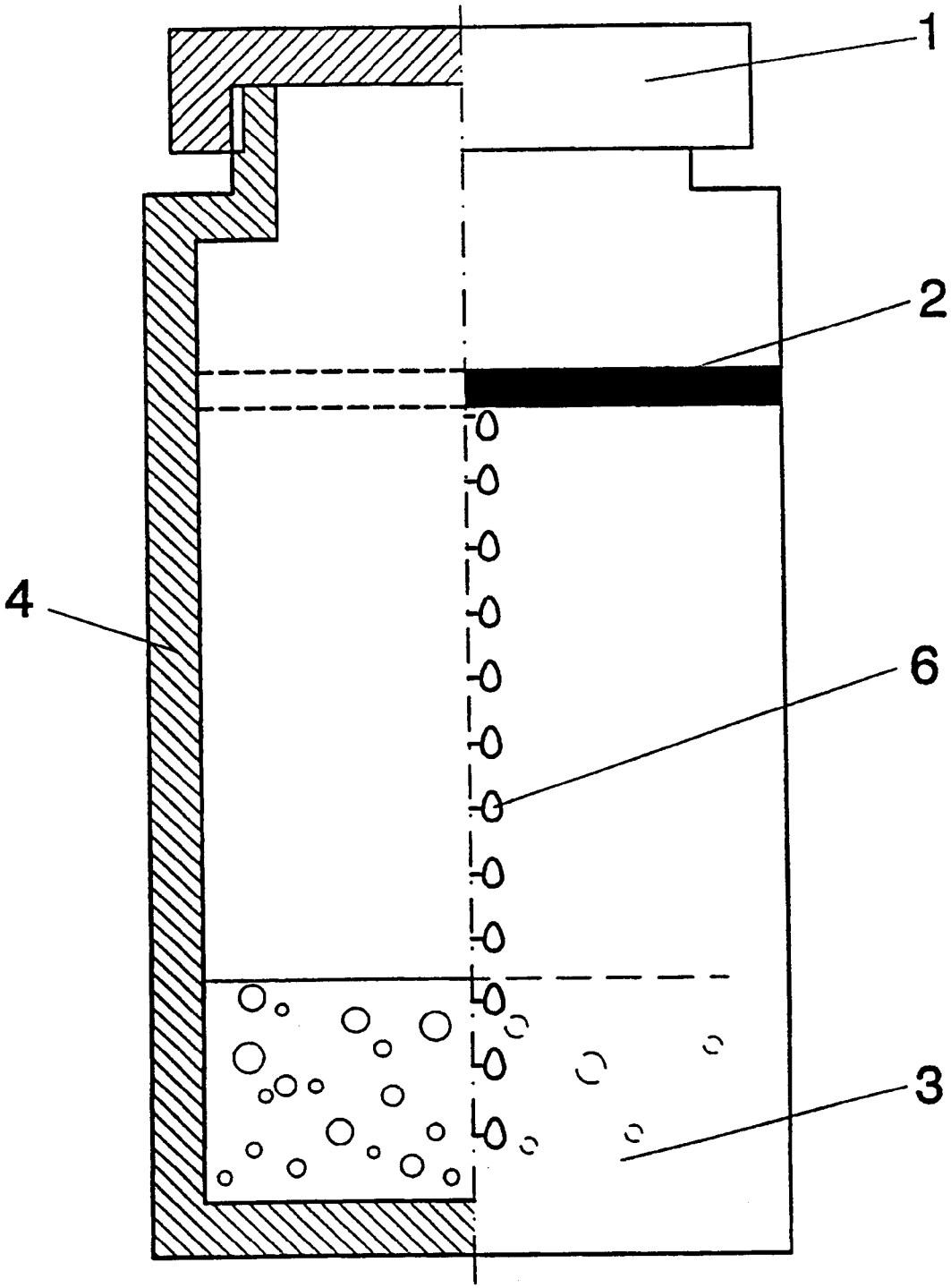
FIG. 1 shows an example of the improved package for pulverulent egg preparations in which the different characteristic parts may be observed, as well as the package appearance before use.
Figure 2:
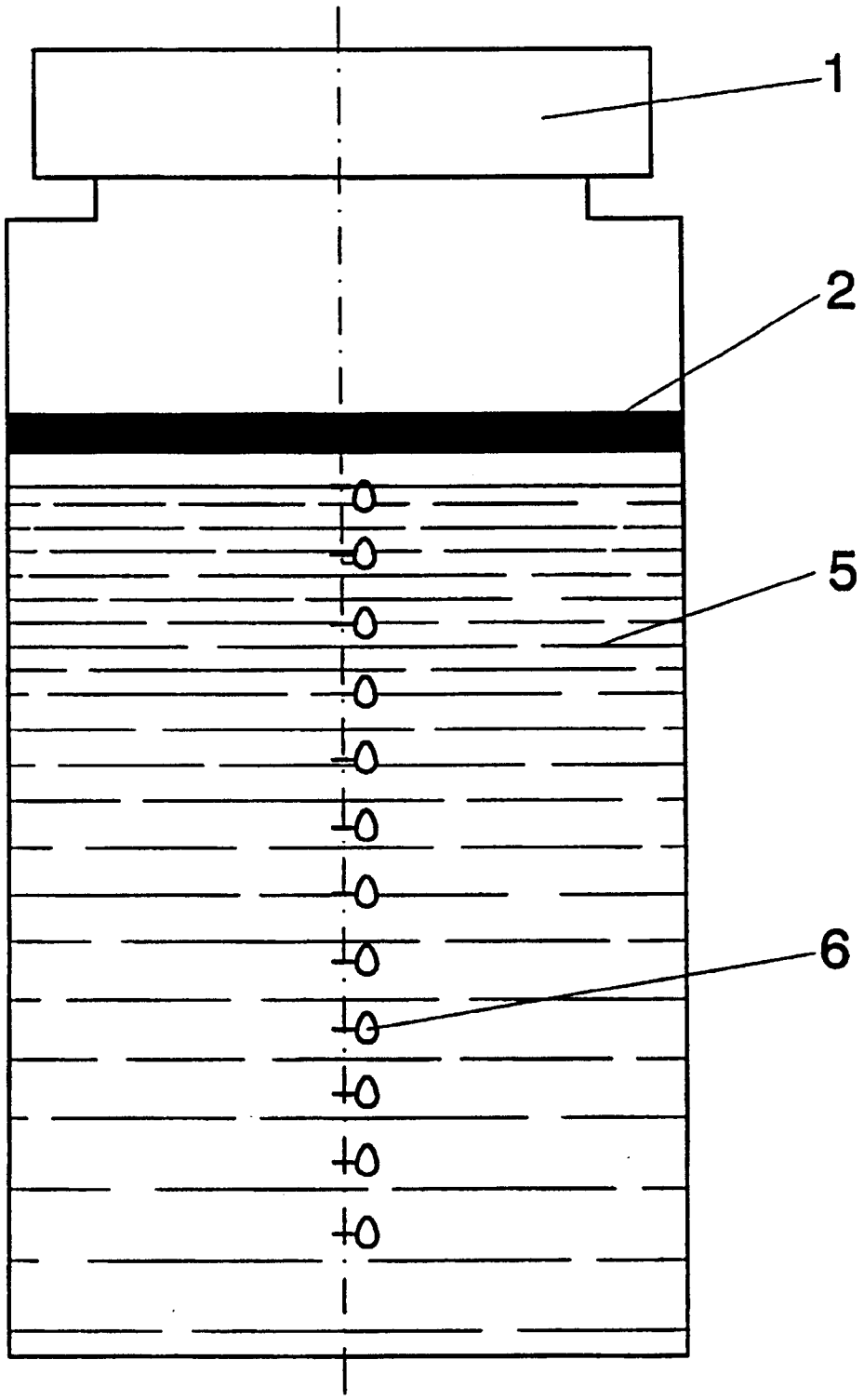
FIG. 2 shows an improved package for pulverulent egg preparations once the mixture has been prepared.

In the figures, the different parts of an improved package (4) for pulverulent egg preparations are observed. In them, we can observe the cover (1) permitting the hermetic sealing of the package and opening and closing thereof, the mark (2) printed on the package serving as a reference when making the mixture and the pulverulent egg (3) ready to be mixed.

The package (4) may be of glass or translucid polyethylene, the latter being preferable due to its more resistant characteristics and in it, there are approximately 110 g egg product (3) ready to be mixed in the reconstitution phase with 390 cubic centimetres of warm water, approximately equivalent to the water lost in the desiccation process of the eggs.

To prepare the liquid egg, it is necessary to open the cover (1), hermetically close to avoid contamination of the contents, and water is added directly from the mains without any type of conditioning, into the package (4) until the mark (2). This mark (2) represents the ideal amount to obtain an optimum product for its consumption and in a single blending without the need of further additions and mixtures of water normal in the preparation methods prior to the present invention. Once the water has reached the mark (2), it is only necessary to close the package (4) with a cover (1) and shake the package (4) until it has been verified that the pulverulent egg (3) has been diluted and the mixture of water and pulverulent egg (3) has been homogenised to give as a result liquid egg (5) suitable for its consumption in an amount of approximately half a litre. The liquid egg (5) obtained corresponds to a dozen class S eggs which have been beaten to obtain the mixture of the yolk and white.

Once mixing has been completed and the liquid egg (5) obtained, the cover (1) will be opened again to use the product as beaten egg but without having to handle eggs. To allow a correct measurement according to the eggs used, the package has on its outside surface some marks with an egg shape facilitating the measure of the number of eggs used since perhaps it is not desired to use the 12 eggs of the package but a lesser number. This compound may be employed for any use that may be given to shelled eggs, like confectionery, battering, omelettes, etc. If not all the homogenised product is used, it is possible to safely preserve it in the refrigerator during the three days following its preparation.

What is claimed is:

1. A package for the preparation of liquid egg from pulverulent egg, the package containing either pulverulent egg or pulverulent egg with other ingredients, the pulverulent egg requiring water for its reconstitution, and being present in an amount that represents a number of beaten eggs which have been dessicated, wherein the package comprises:

only one level or graduation mark on a surface of the package that indicates a fill line for the addition of an exact volume of water approximately equivalent to the water lost by said number of beaten eggs during the dessication process to obtain a proper mixture of a final product, liquid egg, after said water and pulverulent egg is mixed in the package, so that the quantity and initial characteristics of the beaten eggs are restored; and other marks provided on the package surface, wherein each of the other marks directly indicates the number of beaten eggs existing in the mixture in the package when the level of the mixture corresponds to the respective mark, the other marks making it possible to select the desired number of eggs when consuming the liquid egg.

2. A package for the preparation of liquid egg from pulverulent egg in accordance with claim 1, further comprising a cover permitting the opening and closing of the package.

* * * * *